252-95 AU 115 EX
5/5/97 XR 4,663,068

United States Patent [19]
Hagemann et al.

[11] Patent Number: 4,663,068
[45] Date of Patent: May 5, 1987

[54] BLEACH-STABLE DEODORANT PERFUMES IN DETERGENT POWDERS

[75] Inventors: Alfred A. W. A. Hagemann, Kent; George A. Johnson, Merseyside, both of England

[73] Assignee: Lever Brothers Company, New York, N.Y.

[21] Appl. No.: 818,071

[22] Filed: Jan. 13, 1986

Related U.S. Application Data

[63] Continuation of Ser. No. 681,536, Dec. 14, 1984, abandoned.

[30] Foreign Application Priority Data

Dec. 22, 1983 [GB] United Kingdom ..... 8334159

[51] Int. Cl.[4] ..... C11D 3/39; C11D 3/50
[52] U.S. Cl. ..... 252/99; 252/95; 252/106; 252/174.11; 252/102; 252/550; 252/551; 252/554; 252/558; 252/555
[58] Field of Search ..... 252/95, 99, 106, 174.11, 252/522 R

[56] References Cited

U.S. PATENT DOCUMENTS

| | | | |
|---|---|---|---|
| 4,134,838 | 1/1979 | Hooper et al. | 252/8.8 |
| 4,278,658 | 7/1981 | Hooper et al. | 424/65 |
| 4,288,341 | 9/1981 | Hooper et al. | 252/107 |
| 4,289,642 | 9/1981 | Hooper et al. | 252/96 |
| 4,322,308 | 3/1982 | Hooper et al. | 252/107 |
| 4,343,783 | 8/1982 | Hooper et al. | 424/88 |
| 4,347,153 | 8/1982 | Hooper et al. | 252/174.25 |
| 4,422,950 | 12/1983 | Kemper et al. | 252/186.38 |
| 4,469,848 | 9/1984 | Hooper et al. | 252/106 |

*Primary Examiner*—Prince E. Willis
*Attorney, Agent, or Firm*—Milton L. Honig; James J. Farrell

[57] ABSTRACT

A bleach-stable deodorant perfume comprising bleach-stable deodorant perfume components which are judged to be stable in the presence of sodium perborate tetrahydrate and N,N,N'N'-tetraacetyl ethylenediamine (TAED) according to the Bleach Stability Test, the bleach-stable deodorant perfume having a Malodour Reduction Value of from 0.25 to 3.0 as measured by the Malodour Reduction Value Test. Bleaching compositions and detergent products containing the bleach-stable deodorant perfume are also provided.

30 Claims, No Drawings

BLEACH-STABLE DEODORANT PERFUMES IN DETERGENT POWDERS

This is a continuation application of Ser. No. 681,537, filed Dec. 14, 1984 now abandoned.

The invention relates to perfumes which have special deodorant properties and which are stable in the presence of bleaching compositions. The invention also relates to bleaching compositions containing such perfumes. These bleaching compositions are particularly, but not exclusively, suited to the bleaching of fabrics, and for this purpose can also contain detergent active compounds.

BACKGROUND TO THE INVENTION

There has long existed a problem in the formulation of compositions for bleaching fabrics, in that the effective perfuming of such compositions is difficult to achieve, such that the perfume remains stable during storage prior to use and is then available for effective delivery to the bleached fabric without being altered or destroyed by the bleach.

The effective perfuming of fabric that has already been bleached and washed can of course be achieved by incorporation of a suitable perfume in a fabric conditioner to be added during the rinsing or drying stage subsequent to a bleaching step, but this necessitates the introduction of an additional step in the laundry process which can be inconvenient for the user.

PRIOR ART

Deodorant effective detergent products are disclosed in U.S. Pat. No. 4,304,679. These products comprise a non-soap detergent active compound and a deodorant composition consisting of materials which are commonly employed in the perfumery art, but which possess deodorant potential as assessed by objective tests. Materials which pass at least one of these tests are classified according to their chemical structure and properties, and combined according to a set of rules to provide a deodorant composition whose deodorant effectiveness is itself assessed by a subjective panel test.

Deodorant effective soap products particularly suited to the washing of fabrics are disclosed in U.S. Pat. No. 4,289,641. These soap products contain a detergency builder and/or a bleach, as well as a deodorant composition of the type referred to in U.S. Pat. No. 4,304,679.

The effectiveness of deodorant compositions of the type referred to in these two prior art references has been tested exhaustively in fabric washing powder products containing a non-soap detergent active compound as well as a bleaching system consisting of sodium perborate tetrahydrate, as a bleaching agent, and N,N,N',N'-tetraacetyl ethylenediamine (TAED), as bleach activator, and it has been shown that many of the perfumery materials of which the deodorant compositions are comprised are unstable, with a consequent loss during storage of the product of both perfumery and deodorant properties.

Results are given later in this specification to demonstrate the instability in the presence of bleach of many of the perfume materials identified in the above patent specifications as otherwise possessing deodorant potential. For purposes of comparison, results are also given confirming the bleach stability of the remaining perfumery materials identified in these patent specifications as otherwise possessing deodorant potential, in addition to other perfume materials exhibiting bleach-stability whose deodorant potential has not previously been reported.

SUMMARY OF INVENTION

We have now discovered a special type of perfume which when added to powdered or granulated bleaching compositions is not only capable of remaining stable in those compositions for many months without significant loss of fragrance, but also of delivering that fragrance to fabric, particularly soiled fabric, when treated with the bleaching compositions, and of deodorising the bleached fabric such that residual malodour associated with the soil is substantially reduced or eliminated completely from the fabric. We have also demonstrated that a fabric garment, such as a shirt or vest, so treated also retains the ability to reduce body malodour when that garment is worn next to the skin, thus signalling the presence of the special deodorant perfume on the garment, even after drying, ironing and storage before wearing.

In the course of attempts to characterise this phenomenon, many hundreds of perfume materials have been screened firstly for their ability to demonstrate that they have deodorant potential, and secondly for their ability to tolerate storage in the presence of sodium perborate tetrahydrate and TAED as employed in some fabric washing products. As a result of these screening tests, it has been possible to select a group of bleach-stable deodorant perfume materials ideally suited to the formulation of perfumes which perdictably should be both deodorant in character and stable in the presence of bleach. As confirmation of this, perfumes comprising bleach-stable deodorant perfume materials have indeed been checked for their stability in detergent powders containing sodium perborate tetrahydrate and TAED, and to assess their ability to deliver to washed fabric powerful deodorant properties.

These new perfumes are accordingly hereinafter referred to as "bleach-stable deodorant perfumes".

DEFINITION OF THE INVENTION

Accordingly, the invention provides a bleach-stable deodorant perfume which comprises deodorant perfume components which are judged to be stable in the presence of sodium perborate tetrahydrate and N,N,N',N'-tetraacetyl ethylenediamine (TAED) according to the Bleach Stability Test, the bleach-stable deodorant perfume having a Malodour Reduction Value of from 0.25 to 3.0 as measured by the Malodour Reduction Value Test.

More particularly, the invention provides a bleach-stable deodorant perfume which comprises from 50 to 100% by weight of bleach-stable deodorant perfume components and from 0 to 50% by weight of ingredients, said components having a Lipoxidase-Inhibiting Capacity of at least 50% or a Raoult Variance Ratio of at least 1.1, and being judged to be stable in the presence of sodium perborate tetrahydrate and N,N,N',N'-tetraacetyl ethylenediamine (TAED) according to the Bleach Stability Test, said components being allocated to one of six classes consisting of:

Class 1: Phenolic substances

Class 2: Essential oils, extracts, resins and synthetic oils (denoted "AB")

Class 3: Aldehydes and ketones

Class 4: Nitrogen-containing compounds

Class 5: Esters

Class 6: Alcohols and ethers provided that where a bleach-stable deodorant perfume component can be assigned to more than one class, it is allocated to the class having the lower or lowest number; said components being so selected that:

(a) the bleach-stable deodorant perfume contains at least five different components;

(b) the bleach-stable deodorant perfume contains components from at least four of the six classes; and (c) any component present in the bleach-stable deodorant perfume at a concentration of less than 0.5% by weight of the said perfume is eliminated from the requirements of (a) and (b), said bleach-stable deodorant perfume having a Malodour Reduction Value of from 0.25 to 3.0 as measured by the Malodour Reduction Value Test which comprises the steps of:

(i) selecting pieces of 100% bulked polyester sheet shirt fabric of 20 cm×20 cm;

(ii) washing the selected pieces of fabric in a front-loading drum-type washing machine with a standard unperfumed washing powder containing the following ingredients:

| | Parts by weight |
|---|---|
| Sodium dodecylbenzene sulphonate | 9 |
| $C_{13-15}$ alcohol 7EO | 4 |
| Sodium tripolyphosphate | 33 |
| Alkaline sodium silicate | 6 |
| Sodium carboxymethyl cellulose | 1 |
| Magnesium silicate | 1 |
| Ethylenediamine tetraacetic acid | 0.2 |
| Sodium sulphate | 15 |
| Water | 10.8 |

(iii) rinsing the washed pieces of fabric and drying them to provide "untreated" fabric;

(iv) re-washing half of the "untreated" pieces of fabric in the washing machine with the standard washing powder to which has been added 0.2% by weight of a bleach-stable perfume under test, rinsing and re-drying to provide "treated" pieces of fabric;

(v) inserting the "treated" and "untreated" pieces of fabric into clean polyester cotton shirts in the underarm region so that in each shirt, one underarm region receives a "treated" fabric insert and the other underarm region receives an "untreated" fabric insert in accordance with a statistical design;

(vi) placing the shirts carrying the inserts on a panel of 40 Caucasian male subjects of age within the range of 20 to 55 years (the subjects being chosen from those who develop axillary body malodour that is not unusually strong and who do not develop a stronger body malodour in one axilla compared with the other);

(vii) assessing the body malodour of the fabric inserts after a period of five hours whereby three trained female assessors record the olfactory intensity of malodour on a 0 to 5 scale, 0 representing no odour and 5 representing very strong malodour, the strength of the odour in each instance being related for purposes of comparison to standard odours produced by aqueous solutions of isovaleric acid at different concentrations according to the following table:

| Score | Odour level | Conc. of aqueous isovaleric acid (ml/l) |
|---|---|---|
| 0 | No odour | 0 |
| 1 | Slight | 0.013 |
| 2 | Definite | 0.053 |
| 3 | Moderate | 0.22 |
| 4 | Strong | 0.87 |
| 5 | Very Strong | 3.57 |

(viii) calculating the average scores for both treated fabric and untreated fabric, and subtracting the average score of the treated fabric from the average score of the untreated fabric to arrive at the Malodour Reduction Value for the bleach-stable perfume, the bleack-stable perfume being designated a bleach-stable deodorant perfume when its Malodour Reduction Value is from 0.25 to 3.0;

the Bleach Stability Test comprising the steps of:

(i) dosing a perfume material into the standard unperfumed washing powder and incubating the dosed powder at 20° C. in a sealed container for seven days;

(ii) dividing the dosed powder into two portions and adding to each portion sodium perborate tetrahydrate together with either TAED granules or sodium sulphate (to act as an inert filler in place of TAED) to provide test and control formulations having the following constitution:

| | % w/w | |
|---|---|---|
| | Test Powder | Control Powder |
| Standard unperfumed powder | 76 | 76 |
| Perfume material under test | 0.2 | 0.2 |
| Sodium perborate tetrahydrate | 13 | 13 |
| TAED granules (65% TAED) | 10.8 | — |
| Sodium sulphate | — | 10.8 |

(iii) incubating both test and control powders in sealed containers at 45° C. for a further seven days; and (iv) assessing samples of the test and control powders according to a standard triangle test as described in "Manual on Sensory Testing Methods" published by the American Society for Testing and Materials (1969), using a panel of 20 assessors, who are instructed to judge by smell which of the three powder samples is the odd one out, the perfume material being designated a bleach-stable deodorant perfume component when the odd one out is correctly identified by no more than 9 of the 20 assessors.

DISCLOSURE OF THE INVENTION

The bleach-stable deodorant perfume

The characterisation of the bleach-stable deodorant perfume of the invention presents difficulties, since it cannot be defined solely in terms of substances of specific structure and combinations in specified proportions. Nevertheless, procedures have been discovered that enable the essential materials of the bleach-stable deodorant perfume to be identified by tests.

The essential materials required for the formulation of a bleach-stable deodorant perfume are those having a Lipoxidase-Inhibiting Capacity of at least 50% or those having a Raoult Variance Ratio of at least 1.1, and which are judged to be stable in the presence of sodium perborate tetrahydrate and TAED. These properties are determined by the following tests, which are designated the Lipoxidase Test, the Morpholine Test and the Bleach Stability Test respectively.

A large number of materials which satisfy either the Lipoxidase Test or the Morpholine Test, or indeed both tests, and which are also judged to be bleach-stable according to the Bleach Stability Test, is described later in this specification and these are hereafter referred to as "components", in contrast to other materials which do not meet these requirements which are referred to as "ingredients". It is to be understood, however, that the bleach-stable deodorant perfume can contain both "components" and "ingredients", provided that the rules for constructing the perfume from different chemical classes of components, as will be explained later, are followed.

The Lipoxidase Test

In this test, the capacity of a material to inhibit the oxidation of linoleic acid by lipoxidase (EC1.13.1.13) to form a hydroperoxide is measured.

Aqueous 0.2M sodium borate solution (pH 9.0) is used as a buffer.

A control substrate solution is prepared by dissolving linoleic acid (2 ml) in absolute ethanol (60 ml), diluting with distilled water to 100 ml and then adding borate buffer (100 ml) and absolute ethanol (300 ml).

A test substrate solution is prepared in the same way as the control substrate solution except that for the absolute ethanol (300 ml) is substituted the same volume of a 0.5% by weight solution in ethanol of the material to be tested.

A solution of the enzyme lipoxidase in the borate buffer and having an activity within the range of from 15,000 to 40,000 units per ml is prepared.

The activity of the lipoxidase in catalysing the oxidation of linoleic acid is first assayed spectrophotometrically using the control. An automatic continuously recording spectrophotometer is used and the increase in extinction at 234 nm (the peak for hydroperoxide) is measured to follow the course of oxidation, the enzyme concentration used being such that it gives an increase in optical density (ΔOD) at 234 nm within the range of from 0.6 to 1.0 units per minutes. The following materials are placed in two 3 ml cuvettes:

| | Control (ml) | Blank (ml) |
|---|---|---|
| Control substrate solution | 0.10 | 0.10 |
| Absolute ethanol | 0.10 | 0.10 |
| Borate buffer | 2.75 | 2.80 |
| Lipoxidase solution | 0.05 | — |

The lipoxidase solution is added to the control cuvette last and the reaction immediately followed spectrophotometrically for about 3 minutes, with recording of the increase in optical density at 234 nm as a curve on a graph.

The capacity of a material to inhibit the oxidation is then measured using a test sample containing enzyme, substrate and a deodorant material. The following ingredients are placed in two 3 ml cuvettes.

| | Test Sample (ml) | Blank (ml) |
|---|---|---|
| Test substrate solution | 0.10 | 0.10 |
| Absolute ethanol | 0.10 | 0.10 |

-continued

| | Test Sample (ml) | Blank (ml) |
|---|---|---|
| Borate buffer | 2.75 | 2.80 |
| Lipoxidase solution | 0.05 | — |

The lipoxidase solution is added to the test sample cuvette last and the course of the reaction immediately followed as before.

The lipoxidase-inhibiting capacity of the material is then calculated from the formula $100\,(S_1-S_2)/S_1$, where $S_1$ is the slope of the curve obtained with the control and $S_2$ is the slope of the curve obtained with the test sample, and thus expressed as % inhibition. A material that gives at least 50% inhibition in the test is hereafter referred to as having a Lipoxidase-Inhibiting Capacity (LIC value) of at least 50%.

The Morpholine Test

In this test, the capacity of a material to depress the partial vapour pressure of morpholine more than that required by Raoult's Law is measured. Substances that undergo chemical reaction with morpholine, for example aldehydes, are to be regarded as being excluded from the test.

Morpholine (1 g) is introduced into a sample bottle of capacity 20 ml and the bottle fitted with a serum cap. The bottle is then incubated at 37° C. for 30 minutes in order to reach equilibrium. The gas in the headspace of the bottle is analysed by piercing the serum cap with a capillary needle through which nitrogen at 37° C. is passed to increase the pressure in the bottle by a standard amount, the excess pressure then injecting a sample from the headspace into gas chromatograph apparatus, which analyses it and provides a chromatographic trace with a peak due to morpholine, the area under which is proportional to the amount of morpholine in the sample.

The procedure is repeated under exactly the same conditions using instead of morpholine alone, morpholine (0.25 g) and the material to be tested (1 g); and also using the material (1 g) without the morpholine to check whether it gives an interference with the morpholine peak.

The procedure is repeated until reproducible results are obtained. The areas under the morpholine peaks are measured and any necessary correction due to interference by the material is made.

A suitable apparatus for carrying out the above procedure is a Perkin-Elmer Automatic GC Multifract F40 for Head Space Analysis. Further details of this method are described by Kolb in "CZ-Chemie-Technik", Vol 1, No. 2, 87–91 (1972) and by Jentzsch et al in "Z. Anal. Chem." 236, 96–118 (1968).

The measured areas representing the morpholine concentration are proportional to the partial vapour pressure of the morpholine in the bottle headspace. If A is the area under the morpholine peak when only morpholine is tested and A′ is the area due to morpholine when a material is present, the relative lowering of partial vapour pressure of morpholine by the material is given by 1-A′/A.

According to Raoult's Law, if at a given temperature the partial vapour pressure of morpholine in equilibrium with air above liquid morpholine is p, the partial vapour pressure p′ exerted by morpholine in a homogenous liquid mixture of morpholine and material at the same temperature is pM/(M+PC), where M and PC are the molar concentrations of morpholine and material. Hence, according to Raoult's Law the relative lowering of morpholine partial vapour pressure $(p-p')/p$, is given by $1-M/(M+PC)$, which under the circumstances of the test is $87/(87+m/4)$, where m is the molecular weight of the perfume material.

The extent to which the behaviour of the mixture departs from Raoult's Law is given by the ratio $$\frac{1 - A'/A}{87/(87 + m/4)}$$

The above ratio, which will be referred to as the Raoult Variance Ratio, is calculated from the test results. Where a material is a mixture of compounds, a calculated or experimentally determined average molecular weight is used for m. A material that depresses the partial vapour pressure of morpholine by at least 10% more than that required by Raoult's Law is one in which the Raoult Variance Ratio (RVR value) is at least 1.1.

The Bleach Stability Test

The stability of perfume materials to the presence of a bleaching composition is assessed according to a standard test which involves the exposure of these individual perfume materials to a mixture of sodium perborate tetrahydrate and TAED in a detergent fabric washing powder under standard conditions of storage.

In order to perform this test, a detergent powder base is prepared according to a standard blowing technique to form a granulated product. The formulation of the detergent powder base is as follows:

| | Parts by weight |
|---|---|
| Sodium dodecylbenzene sulphonate | 9 |
| $C_{13-15}$ fatty alcohol 7EO | 4 |
| Sodium triphosphate | 33 |
| Alkaline sodium silicate | 6 |
| Sodium carboxymethyl cellulose | 1 |
| Magnesium silicate | 1 |
| Ethylenediamine tetraacetic acid | 0.2 |
| Sodium sulphate | 15 |
| Water (as moisture) | 10.8 |

A selected perfume material is then incorporated by mixing with a portion of the blown base powder to a final concentration of 0.2% by weight of the finished product, and stored at 20° C. in a sealed container for one week with occasional mixing to ensure an even concentration of the perfume material throughout the powder. The sample is the split into two portions and further ingredients mixed in to provide the following test and control formulations:

| | % w/w | |
|---|---|---|
| | Test | Control |
| Detergent powder base | 76 | 76 |
| Perfume material | 0.2 | 0.2 |
| Sodium perborate tetrahydrate | 13.0 | 13.0 |
| TAED granules (65% TAED) | 10.8 | — |
| Sodium sulphate | — | 10.8 |

100 g samples of each control and test batch of powder containing a selected perfume material are then sealed in containers and stored at 45° C. for one week. Each sample is then assessed in a forced choice triangle test according to the following procedure:

Three samples of powder, either one from the test batch and two from the control batch, or two from the test batch and one from the control batch are then assessed by a panel of 20 assessors who are asked to select by sniffing which of the three samples is the "odd one out".

The fragrance of samples containing bleach-stable perfume materials should be unchanged following incubation in the presence of the perborate and TAED, and accordingly there is a 1 in 3 chance of an assessor selecting correctly the control or test sample as the "odd one out".

Samples containing perfume materials which are not bleach-stable show a change of note or marked reduction in fragrance intensity in the presence of perborate and TAED, and accordingly there is better than a 2 in 3 chance of an assessor selecting the control or test sample as the "odd one out".

The Triangle Test procedure is described and discussed in "Manual on Sensory Testing Methods" published by the American Society for Testing and Materials (1969).

The results of each Triangle Test are calculated as follows:

If 10 or more of the 20 assessors choose correctly the "odd one out" of the three samples, then the perfume material under test is judged to be unstable in the presence of bleach. If, however, up to 9 of the 20 accessors choose correctly the "odd one out" of 3 samples, then the perfume material under test is judged to be stable in the presence of bleach.

Classification of deodorant perfume components

In addition to their bleach stability, the deodorant perfume components will also be classified into six chemically defined classes. However, before defining this classification in greater detail, it is necessary first to clarify some of the terms that will be employed in assigning certain of the perfume components to a chemical class. This is done first by describing the perfume components in terms of four categories, each of which is given below together with examples of components which are to be assigned to each category.

(1) Single chemical compounds whether natural or synthetic, for example, iso-eugenol: the majority of components are in this category.

(2) Synthetic reaction products (products of reaction), mixtures of isomers and possibly homologues, for example, α-iso-methyl ionone.

(3) Natural oils and extracts, for example, clove leaf oil.

(4) Synthetic oils: this category includes materials that are not strict analogues of natural oils but are materials that result from attempts to copy or improve upon certain natural oils, for example Bergamot AB 430 and Geranium AB 76.

Components of Categories (3) and (4) although often uncharacterised chemically are available commercially.

Where a material is supplied or used conventionally for convenience as a mixture, e.g. p-t-amyl cyclohexanone diluted with diethyl phthalate, for the purposes of this specification two components are present, so that use of 5% of a blend of 1 part of this ketone and 9 parts of diethylphthalate is represented as 0.5% of the ketone and 4.5% of diethyl phthalate.

It has been found advantageous in formulating the most effective bleach-stable deodorant perfumes to use components that, as well as satisfying the lipoxidase or morpholine tests and being judged to be bleach-stable, satisfy further conditions. These conditions are:

(i) there must be at least five different components present;

(ii) there must be represented components from at least four different chemical classes (to be defined below);

(iii) at least 50%, preferably at least 55% and most preferably from 60 to 100% by weight of the bleach-stable deodorant perfumes must comprise components;

(iv) a component is not considered to contribute to the efficacy of the bleach-stable deodorant perfume if it is present in that perfume at a concentration of less than 0.5% by weight.

Each component should be allocated to one of six classes. These classes are:

Class 1—Phenolic substances;

Class 2—Essential oils, extracts, resins and synthetic oils (denoted "AB");

Class 3—Aldehyde and ketones;

Class 4—Nitrogen-containing compounds;

Class 5—Esters;

Class 6—Alcohols and ethers.

In assigning a component to a class, the following rules are to be observed. Where the component could be assigned to more than one class, the component is allocated to the class occurring first in the order given above: for example methyl anthranilate, which is a nitrogen-containing compound, is placed in Class 4, although as an ester it otherwise might have been allocated to Class 5. Similarly, ethyl salicylate, which is phenolic in character, is allocated to Class 1 instead of Class 5.

The following are examples of bleach-stable deodorant perfume components that have either a Lipoxidase Inhibiting Capacity (LIC value) of at least 50% or a Raoult Variance Ratio (RVR value) of at least 1.1, and additionally have a Bleach Stability Test (BST) panel score of up to 9, indicating that they are judged to be bleach-stable. Their class, molecular weight (m), LIC and RVR values and BST panel scores as determined by the tests already described herein are also indicated.

The nomenclature adopted for the components listed below and for the perfume ingredients which appear in the perfume formulations of Examples 1 to 7 is, so far as is possible, that employed by Steffan Arctander in "Perfume and Flavour Chemicals (Aroma Chemicals)" Volume I and II (1969) and the "Perfume and Flavour Chemicals (Aroma Chemicals)" Volume I and II (1969) and the "Perfume & Flavour Materials of Natural Origin" (1960) by the same author. Where a component or ingredient is not described by Arctander, then either the chemical name is given or, where this is not known the perfumery house speciality code name is given. Note that synthetic oils denoted "AB" are available from Proprietary Perfumes & Flavours International Limited.

Specific examples of perfume components are:

| | LIC value | RVR value | m | BST panel score |
|---|---|---|---|---|
| Class 1 - Phenolic Substances | | | | |
| iso-Amyl salicylate | 95 | 1.24 | 208 | 9 |
| Carvacrol | 32 | 1.43 | 150 | 6 |
| Clove leaf oil | 79 | 1.43 | 164 | 5 |
| Ethyl salicylate | — | 1.19 | 194 | 7 |
| iso-Eugenol | 100 | 1.48 | 164 | 4 |
| Hexyl salicylate | 100 | — | 222 | 5 |

-continued

| | LIC value | RVR value | m | BST panel score |
|---|---|---|---|---|
| Thyme oil red | 55 | 1.37 | 150 | 9 |
| Class 2 - Essential oils, extracts, resins and synthetic oils (denoted "AB") | | | | |
| Bergamot AB 430 | 58 | 0.97 | 175 | 7 |
| Geranium AB 76 | 26 | 1.29 | 154 | 6 |
| Rose AB 380 | 0 | 1.28 | 175 | 9 |
| Rose AB 409 | 35 | 1.34 | 175 | 8 |
| Class 3 - Aldehydes and ketones | | | | |
| 6-Acetyl-1,1,3,4,4,6-hexamethyl-tetrahydro-naphthalene | 100 | 1.03 | 258 | 8 |
| p-t-Amyl cyclohexanone | 50 | 1.10 | 182 | 8 |
| 2-n-Heptylcyclo-pentanone | 56 | 1.05 | 182 | 7 |
| α-iso-Methyl ionone | 100 | 1.13 | 206 | 7 |
| β-Methyl naphthyl ketone | 100 | 0.96 | 170 | 3 |
| Class 4 - Nitrogen-containing compounds | | | | |
| iso-Butyl quinoline | — | 1.10 | 185 | 5 |
| Methyl anthranilate | 69 | 1.20 | 151 | 6 |
| Class 5 - Esters | | | | |
| o-t-Butylcyclohexyl acetate | 52 | 1.08 | 198 | 8 |
| Diethyl phthalate | 79 | 1.20 | 222 | 4 |
| Nonanediol-1,3-diacetate | 33 | 1.17 | 244 | 8 |
| Nonanolide-1,4 | 92 | 0.87 | 156 | 5 |
| i-Nonyl acetate | 50 | 0.83 | 186 | 4 |
| i-Nonyl formate | 19 | 1.49 | 172 | 8 |
| Phenylethyl phenyl acetate | 0 | 1.22 | 241 | 7 |
| Class 6 - Alcohols & Ethers | | | | |
| Cinnamic alcohol | — | 1.28 | 134 | 9 |
| Dimyrcetol | 16 | 1.22 | 156 | 9 |
| 1,3,4,6,7,8-Hexahydro-4,6,6,7,8,8-hexamethyl cyclopenta-α-2-benzopyran | 100 | — | 240 | 5 |
| Hydroxymethyl isopropyl cyclopentane | 60 | 1.23 | 142 | 8 |
| 3a-Methyl-dodecahydro-6,6,9a-trimethylnaphtho-2(2,1-b)furan - | 58 | 1.30 | 230 | 5 |
| Tetrahydromuguol | 24 | 1.23 | 158 | 8 |

Examples of perfume ingredients that are *not* bleach-stable, which accordingly are not likely to contribute substantially to the deodorant properties of the perfume when formulated in the presence of bleach materials are as follows:

| | LIC value | RVR value | m | BST panel score |
|---|---|---|---|---|
| Benzoin Siam resinoid | 87 | — | — | 14 |
| Benzyl salicylate | 0 | 1.58 | 228 | 17 |
| Bergamot AB 37 | 58 | 0.97 | 175 | 10 |
| p-t-Butyl cyclohexyl acetate | 54 | 0.98 | 198 | 10 |
| p-t-Butyl-α-methyl hydrocinnamic aldehyde | 74 | — | 204 | 13 |
| Coumarin | 58 | 1.22 | 146 | 10 |
| Ethyl vanillin | 100 | 1.43 | 152 | 12 |
| Geranium oil Bourbon | 26 | 1.29 | 154 | 10 |
| LRG 201 | 100 | 1.21 | 196 | 11 |
| Mousse de chene Yugo | 98 | 1.29 | 182 | 11 |
| β-Naphthyl methyl ether | 100 | — | 158 | 11 |
| Opoponax resinoid | 96 | 1.33 | 150 | 11 |
| Patchouli oil | 76 | 1.25 | 140 | 11 |
| Petitgrain oil | 34 | 1.27 | 175 | 11 |
| Phenylethyl alcohol | 22 | 1.24 | 122 | 10 |
| Pimento leaf oil | 100 | — | 165 | 12 |
| Pomeransol AB 314 | 100 | — | — | 11 |

As has already been stated, a bleach-stable deodorant perfume should contain at least five different bleach-stable components. It is however possible, and indeed is usually advantageous, to employ more than five different bleach-stable components when formulating the perfume. Ideally, most if not all of the perfume is formulated from bleach-stable deodorant perfume components.

Likewise, it has been stated that at least four different classes of components should be represented in the bleach-stable deodorant perfume. Superior perfumes can however be obtained if more than four classes are represented. Accordingly, preferably five or all six classes can be represented in the bleach-stable deodorant perfume.

It has been shown by the preparation, examination and testing of many bleach-stable deodorant perfumes that the best results are obtained by keeping within the aforementioned rules. For example, bleach-stable deodorant perfumes which contain less than the minimum concentration of components of 50% are unlikely to result in a perfume which has a sufficient deodorant property expressed in terms of its Malodour Reduction Value as hereinafter defined.

It should be explained that components present in the bleach-stable deodorant perfume for purposes other than obtaining a deodorant effect, for example an adjunct like an anti-oxidant, are excluded from the operation of the preceding instructions to the extent that the component is required for that other purpose. The levels at which adjuncts are conventionally present in perfumes or in products to which perfumes are added is well-established for conventional materials and readily determinable for new materials so that the application of the above exclusion presents no difficulty.

Measurement of Malodour Reduction

It is a necessary property of the bleach-stable deodorant perfume of the invention that it should satisfy a deodorancy test when applied to fabric which is subsequently placed in contact with the skin of human subjects. The average amount by which body malodour transferred to the fabric is reduced is expressed in terms of the Malodour Reduction Value of the bleach-stable deodorant perfume. Perfumes of the invention accordingly have a Malodour Reduction Value of from 0.25 to 3.0. Perfumes which have a Malodour Reduction Value of below 0.25 are outside the scope of this invention and are considered to be incapable of reducing body malodour transferred to fabric from human skin to a significant extent.

The Malodour Reduction Value Test

In this test, the Malodour Reduction Value of a bleach-stable deodorant perfume is measured by assessing its effectiveness, when applied to fabric, in reducing body malodour when the fabric so treated is placed in contact with the axillae (armpits) of a panel of human subjects, and held there for a standard period of time. From subsequent olfactory evaluation by trained accessors, the Malodour Reduction Value can be calculated so giving a measure of the effectiveness as a deodorant of the bleach-stable perfume under test.

Preparation of the bleach-stable deodorant perfume treated fabric

100% bulked polyester shirt fabric is selected for the test and cut into 20 cm×20 cm squares, which are then washed in a front-loading drum-type washing machine with a standard unperfumed washing powder containing the following ingredients:

| | Parts by weight |
|---|---|
| Sodium dodecylbenzene sulphonate | 9 |
| $C_{13-15}$ alcohol 7EO | 4 |
| Sodium tripolyphosphate | 33 |
| Alkaline sodium silicate | 6 |
| Sodium carboxymethyl cellulose | 1 |
| Magnesium silicate | 1 |
| Ethylenediamine tetraacetic acid | 0.2 |
| Sodium sulphate | 15 |
| Water | 10.8 |

The washed pieces of fabric are then rinsed with cold water and finally dried. The shirt fabric squares so obtained represent "untreated" fabric, that is fabric devoid of perfume, other deodorant materials, dressing and other water-soluble substances that subsequently might adversely affect the Malodour Reduction Value Test.

The untreated pieces of fabric are divided into two batches, one of which receives no further washing treatment and represents the control fabric in the test. The other batch of fabric pieces is re-washed in the washing machine with the same standard fabric washing powder to which has been added 0.2% by weight of the bleach-stable perfume under test. The perfume treated pieces of fabric are then rinsed with cold water and dried again. The shirt fabric squares so obtained represent "treated" fabric, that is fabric onto which the test bleach-stable deodorant perfume been delivered.

Conduct of the Malodour Reduction Test

A term of three Caucasian female assessors of age within the range of 20 to 40 years is selected for olfactory evaluation on the basis that each is able to rank correctly the odour levels of the series of standard aqueous solutions of isovaleric acid listed in Table 1 below, and each is able to assign a numerical score, corresponding to the odour intensity of one of these solutions, to the body malodour of a shirt insert after it has been worn in the axilliary region by a male subject for a standard period of time.

A panel of 40 human subjects for use in the test is assembled from Caucasian male subjects of age within the range of from 20 to 55 years. By screening, subjects are chosen who develop axilliary body malodour that is not unusually strong and who do not develop a stronger body malodour in one axilla compared with the other. Subjects who develop unusually strong body malodour, for example due to a diet including curry or garlic, are not selected for the panel.

For two weeks before the start of the test, the panel subjects are assigned an unperfumed, non-deodorant soap bar for exclusive use when washing and are denied the use of any other type of deodorant or antiperspirant. At the end of this period, the 40 subjects are randomly divided into two groups of 20.

The "treated" and "untreated" shirt fabric pieces are then tacked into 40 clean polyester cotton shirts in the underarm region in such a manner that in 20 shirts, the untreated (control) fabric pieces are attached inside the left underarm region, and the "treated" (test) fabric pieces are attached in the right underarm region.

For the remaining 20 shirts, the placing of control and test pieces of fabric is reversed.

The shirts carrying the tacked-in fabric inserts are then worn by the 40 panel members for a period of 5 hours, during which time each panellist performs his normal work function without unnecessary exercise.

After this five hour period, the shirts are removed and the inserts detached and placed in polyethylene pouches prior to assessment by the trained panel of assessors.

The malodour intensity of each fabric insert is evaluated by all three assessors who, operating without knowledge of which inserts are "treated" and which are "untreated" and, without knowing the scores assigned by their fellow assessors, sniff each fabric piece and assign to it a score corresponding to the strength of the odour on a scale from 0 to 5, with 0 representing no odour and 5 representing very strong odour.

The standard aqueous solutions of isovaleric acid which correspond to each of the scores 1, 2, 3, 4 and 5 are provided for reference to assist the assessors in the malodour evaluation. These are shown in Table 1 below.

| Score | Odour level | Conc. of aqueous isovaleric acid (ml/l) |
|---|---|---|
| 0 | No odour | 0 |
| 1 | Slight | 0.013 |
| 2 | Definite | 0.053 |
| 3 | Moderate | 0.22 |
| 4 | Strong | 0.87 |
| 5 | Very Strong | 3.57 |

The scores recorded by each accessor for each fabric piece are averaged, and the average score of the "treated" (test) fabric pieces is deducted from the average score of the "untreated" (control) fabric pieces to give the Malodour Reduction Value of the bleach-stable deodorant perfume.

As a check that the selection of panel subjects is satisfactory for operation of the test, the average score with the control fabric pieces should be between 2.5 and 3.0.

Although the invention in its widest aspect provides bleach-stable deodorant perfumes having a Malodour Reduction Value of from 0.25 to 3.0, preferred bleach-stable deodorant perfumes are those which have a Malodor Reduction Value of at least 0.30, or 0.40, or 0.50, or 0.60, or 0.70, or 1.00. The higher the minimum value, the more effective is the bleach-stable perfume as a deodorant as recorded by the assessors in the Malodour Reduction Value Test. It has also been noted that consumers, who are not trained assessors, can detect by self-assessment a noticeable reduction in malodour on soiled fabric such as shirts and underclothes where the Malodour Reduction Value is at least 0.30, the higher the Malodour Reduction Value above this figure, the more noticeable is the deodorant effect.

To summarize, the definition of a bleach-stable deodorant perfume is based on two criteria. Firstly, that it comprises at least 50%, preferably 55%, and most preferably from 60 to 100% by weight of bleach-stable deodorant components, and secondly, that the perfume comprising the quantity of components should possess a Malodor Reduction Value of from 0.25 to 3.0. It is to be understood that where such a perfume contains less than 100% by weight of bleach-stable perfume components, then the balance of perfume materials present can be perfume ingredients. Accordingly, the bleach-stable deodorant perfume can comprise from 0 to 50% by weight of perfume ingredients that may be unstable in the presence of bleach substances. Although these unstable materials may lose their perfume characteristics when exposed to bleach substances, it is sufficient that those perfume materials (i.e. components) that survive this exposure are collectively able to exhibit a Malodour Reduction Value of at least 0.25.

BLEACHING COMPOSITIONS

The bleach-stable deodorant perfumes according to the invention can advantageously be employed in a bleaching composition, particularly a composition that can be used in the bleaching or washing of fabrics or the bleaching or cleaning of hard surfaces.

Accordingly, the invention also provides a bleaching composition comprising a peroxy bleach compound, together with an activator therefor, and a bleach-stable deodorant perfume as defined herein. Preferably, the peroxy bleach compound is an inorganic persalt.

The inorganic persalt, acts to release active oxygen in solution, and the activator therefor is usually an organic compound having one or more reactive acyl residues, which cause the formation of peracids, the latter providing a more effective bleaching action at a low temperature, that is, in the range from 20° to 60° C., than is possible with the inorganic persalt itself.

The peroxybleach compound and the activator therefore will normally together form from 1 to 99.99%, preferably from 6 to 95% by weight of the bleaching composition.

The ratio by weight of the peroxy bleach compound to the activator in the bleaching composition may vary from about 30:1 to about 1:1, preferably from 15:1 to 2:1.

Typical examples of suitable peroxy bleach compounds are inorganic persalts such as alkali metal perborates, both tetrahydrates and monohydrates, alkali metal percarbonates, persilicates and perphosphates and mixtures thereof. Sodium perborate is the preferred inorganic persalt, particularly sodium perborate monohydrate and sodium perborate tetrahydrate.

Activators for peroxy bleach compounds have been described in the literature, including British Pat. Nos. 836 988, 855 735, 907 356, 907 358, 970 950, 1 003 310 and 1 246 339, U.S. Pat. Nos. 3,332,882 and 4,128,494, Canadian Pat. No. 844 481 and South African Pat. No. 68/6344. Specific suitable activators include:

(a) N-diacylated and N,N'-polyacrylated amines, for example N,N,N'N'-tetraacetyl methylenediamine and N,N,N'N'-tetraacetyl ethylenediamine, N,N-diacetylaniline, N,N-diacetyl-p-toluidine; 1,3-diacylated hydantoins such as, for example, 1,3-diacetyl-5,5-dimethyl hydantoin and 1,3-dipropionyl hydantoin; α-acetoxy-(N,N')-polyacrylmalonamide, for example α-acetoxy-(N,N')-diacetylmalonamide;

(b) N-alkyl-N-sulphonyl carbonamides, for example the compounds N-methyl-N-mesyl-acetamide, N-methyl-N-mesyl-benzamide, N-methyl-N-mesyl-p-nitrobenzamide and N-methyl-N-mesyl-p-methoxybenzamide;

(c) N-acylated cyclic hydrazides, acylated triazones or urazoles, for example monoacetylmaleic acid hydrazide;

(d) O,N,N-trisubstituted hydroxylamines, for example O-benzoyl-N,N-succinyl hydroxylamine, O-acetyl-N,N-succinyl hydroxylamine, O-p-methoxybenzoyl-N,N-succinyl hydroxylamine, O-p-nitrobenzoyl-N,N-succinyl hydroxylamine and O,N,N-triacetyl hydroxylamine;

(e) N,N'-diacyl-sulphurylamides, for example N,N'-dimethyl-N,N'-diacetyl sulphurylamide and N,N'-diethyl-N,N'-dipropionyl sulphurylamide;

(f) Triacylcyanurates, for example triacetyl cyanurate and tribenzoyl cyanurate;

(g) Carboxylic acid anhydrides, for example benzoic anhydride, m-chloro-benzoic anhydride, phthalic anhydride and 4-chloro-phthalic anhydride.

(h) Sugar esters, for example glucose pentaacetate;

(i) Esters of sodium p-phenol sulphonate, for example sodium acetoxybenzene sulphonate, sodium benzoyloxybenzene sulphonate, and high acyl derivatives, for example linear and branched octanoyl and nonanoyl phenol sulphonic acid salts.

(j) 1,3-diacyl-4,5-diacyloxy-imidazoline, for example 1,3-diformyl-4,5-diacetoxy-imidazolidine, 1,3-diacetyl-4,5-diacetoxy-imidazoline, 1,3-diacetyl-4,5-dipropionyloxy-imidazoline;

(k) N,N'-polyacrylated glycoluril, for example N,N,N'N'-tetraacetyl glycoluril and N,N,N'N'-tetrapropionylglycoluril;

(l) Diacylated-2,5-diketopiperazine, for example 1,4-diacetyl-2,5-diketopiperazine, 1,4-dipropionyl-2,5-diketopiperazine and 1,4-dipropionyl-3,6-dimethyl-2,5-diketopiperazine;

(m) Acylation products of propylenediurea or 2,2-dimethyl-propylenediurea (2,4,6,8-tetraazabicyclo-(3,3,1)-nonane-3,7-dione or its 9,9-dimethyl derivative), especially the tetraacetyl- or the tetrapropionyl-propylenediurea or their dimethyl derivatives;

(n) Carbonic acid esters, for example the sodium salts of p-(ethoxycarbonyloxy)-benzoic acid and p-(propoxycarbonyloxy)-benzene sulphonic acid.

The N-diacetylated and N,N'-polyacrylated amines mentioned under (a) are of special interest, particularly N,N,N'N'-tetraacetyl ethylenediamine (TAED).

Mixtures of one or more of the foregoing activators can be employed in the bleaching compositions.

It is preferred to use the activator in granular form, especially when it is present in a finely divided form as described in British Patent Specification No. 2 053 998. Specifically, it is preferred to employ an activator having an averge particle size of less than 150 micrometers (μm), which gives significant improvement in bleach efficiency. The sedimentation losses, when using an activator with an average particle size of less than 150 μm, are substantially decreased. Even better bleach performance is obtained if the average particle size of the activator is less than 100 μm. However, too small a particle size gives increased decomposition, dust formation and handling problems, and although particle sizes below 100 μm can provide an improved bleaching efficiency, it is desirable that the activator should not have more than 20% by weight of particles with a size of less than 50 μm. On the other hand, the activator may have a certain amount of particles of a size greater than 150 μm, but it should not contain more than 5% by weight of particles >300 μm, and not more than 20% by weight of particles >150 μm. If needle-shaped crystalline activator particles are used, these sizes refer to the needle diameter. It is to be understood that these particle sizes refer to the activator present in the granules, and not to the granules themselves. The latter generally have on average a particle size of from 100 to 2000 μm, preferably 250 to 1000 μm. Up to 5% by weight of granules with a particle size of >1600 μm and up to 10% by weight of granules <250 μm is tolerable. The granules incorporating the activator, preferably in this finely divided form, may be obtained by granulating the activator with a suitable carrier material, such as sodium tripolyphosphate and/or potassium tripolyphosphate. Other granulation methods, for example using organic and/or inorganic granulation aids, can also usefully be applied. The granules can be subsequently dried, if required. Generally, any granulation process is applicable, so long as the granule contains the activator, and so long as the other materials present in the granule do not inhibit the activator.

The bleaching composition comprising a peroxy bleach compound and an activator thereafter, as herein defined, will normally contain from 0.01 to 5%, preferably from 0.1 to 0.5% and most preferably from 0.2 to 0.4% by weight of the bleach-stable deodorant perfume.

It is apparent that if less than 0.01% by weight of a bleach-stable deodorant perfume is employed, then use of the bleaching composition is unlikely to provide a significant level of residual fragrance or deodorancy on soiled fabric or on other surfaces bleached with the product, nor is such a low level of the bleach-stable deodorant perfume likely to provide a significant reduction in body malodour of fabrics subsequently worn following treatment with the bleaching composition. If more than 5% by weight of a bleach-stable deodorant perfume is employed, then use of the bleaching composition is unlikely to impart a higher level of fragrance or deodorancy, to treated fabrics or other surfaces, or to reduce further body malodour of fabrics subsequently worn, beyond that observed at the 5% by weight level.

DETERGENT PRODUCTS

The bleaching composition can optionally also comprise soap and/or non-soap detergent active compounds to form a detergent product. Such products can accordingly be employed both to clean and to bleach fabrics at a relatively low wash temperature of from 20° C. to 60° C. They can also be used to clean hard surfaces other than fabrics, such as are to be found in the domestic kitchen and bathroom.

Detergent active compounds

According to a preferred embodiment of the invention, the detergent product comprises from 5 to 40%, preferably from 8 to 30% by weight of detergent-active compound, from 1 to 30%, preferably from 5 to 20% by weight of peroxy bleach compound together with an activator therefor, and from 0.1 to 5%, preferably from 0.2 to 0.5% by weight of a bleach-stable deodorant perfume as herein defined.

The detergent active compound is chosen from a soap, and non-soap anionic, cationic, nonionic, amphoteric or zwitterionic detergent active compounds, and mixtures thereof. Many suitable detergent-active compounds are commercially available and are fully described in the literature, for example in "Surface Active Agents and Detergents", Volumes I and II, by Schwartz, Perry and Berch.

The preferred detergent-active compounds which can be used are soaps and synthetic non-soap anionic and nonionic compounds.

Soap is a water-soluble or water-dispersible alkali metal salt of an organic acid, and the preferred soaps are sodium or potassium salts, or the corresponding ammonium or substituted ammonium salts of an organic acid. Examples of suitable organic acids are natural or synthetic aliphatic carboxylic acids of from 10 to 22 carbon atoms, especially the fatty acids of triglyceride oils such as tallow, coconut oil and rape seed oil.

The soap which is most preferred is a soap derived from rape seed oil. When soap derived from tallow fatty acids is chosen, then fatty acids derived from tallow class fats, for example beef tallow, mutton tallow, lard, palm oil and some vegetable butters can be selected. Minor amounts of up to about 30%, preferably 10 to 20%, by weight of sodium soaps of nut oil fatty acids derived from nut oils, for example coconut oil and palm kernel oil, may be admixed with the sodium tallow soaps, to improve their lathering and solubility characteristics if desired. Whereas tallow fatty acids are predominantly $C_{14}$ and $C_{18}$ fatty acids, the nut oil fatty acids are of shorter chain length and are predominantly $C_{10}$–$C_{14}$ fatty acids.

Synthetic anionic non-soap detergent active compounds when employed are usually water-soluble alkali metal salts of organic sulphates and sulphonates having alkyl radicals containing from about 8 to about 22 carbon atoms, the term alkyl being used to include the alkyl portion of higher aryl radicals.

Preferred examples of suitable anionic detergent compounds are sodium and potassium alkyl sulphates, especially those obtained by sulphating higher ($C_8$–$C_{18}$) alcohols produced for example from tallow or coconut oil; sodium, potassium and ammonium alkyl benzene sulphonates, particularly linear alkyl benzene sulphonates having from 10 to 16, especially from 11 to 13 carbon atoms in the alkyl chain; sodium alkyl glyceryl ether sulphates, especially those ethers of the higher alcohols derived from tallow or coconut oil and synthetic alcohols derived from petroleum; sodium coconut oil fatty acid monoglyceride sulphates and sulphonates; sodium and potassium salts of sulphuric acid esters of higher ($C_9$–$C_{18}$) fatty alcohol-alkylene oxide, particularly ethylene oxide, reaction products; the reaction products of fatty acids such as coconut fatty acids esterified with isethionic acid and neutralized with sodium hydroxide; sodium and potassium salts of fatty acid amides of methyl taurine; alkane monosulphonates such as those derived by reacting alpha-olefins ($C_8$–$C_{20}$) with sodium bisulphite and those derived by reacting paraffins with $SO_2$ and $Cl_2$ and then hydrolysing with a base to produce a random sulphonate; olefin sulphonates, which term is used to describe the material may be reacting olefins, particularly $C_{10}$–$C_{20}$ alpha-olefins, with $SO_3$ then neutralising and hydrolysing the reaction product; or mixtures thereof. The preferred anionic detergent compounds are sodium ($C_{11}$–$C_{15}$) alkyl benzene sulphonates and sodium ($C_6$–$C_{18}$) alkyl sulphates.

Examples of suitable nonionic detergent compounds which may be used include the reaction products of alkylene oxides, usually ethylene oxide, with alkyl ($C_6$–$C_{22}$) phenols, generally 5 to 25 EO, i.e. 5 to 25 units of ethylene oxide per molecule; the condensation products of aliphatic ($C_8$–$C_{18}$) primary or secondary linear or branched alcohols with ethylene oxide, generally 4 to 30 EO, and products made by condensation of ethylene oxide with the reaction products of propylene oxide and ethylenediamine. Other so-called nonionic detergent compounds include long-chain tertiary amine oxides, long-chain tertiary phosphine oxides and dialkyl sulphoxides.

Mixtures of detergent-active compounds, for example mixed anionic or mixed anionic and nonionic compounds, may be used in the detergent products, particularly in the latter case to provide controlled low sudsing properties. This is beneficial for products intended for use in suds-intolerant automatic washing machines.

Cationic, amphoteric or zwitterionic detergent-active compounds optionally can also be used in the detergent products, but this is not normally desired owing to their relatively high cost. If any cationic, amphoteric or zwitterionic detergent-active compounds are used, it is generally in small amounts in products based on the much more commonly used synthetic anion and/or nonionic detergent-active compounds.

Other detergent adjuncts

Detergent products containing bleach-stable deodorant perfumes of the invention can also contain other ingredients (adjuncts), which can include, in addition to bleaching materials, a detergency builder to provide a built detergent product, as well as other adjuncts.

Detergency builders

Builders include soaps, inorganic and organic water-soluble builder salts, as well as various water-insoluble and so-called "seeded" builders, who function is to soften hard water by solubilisation or by removal by other means (e.g. by sequestration or by precipitation) of calcium and to a lesser extent magnesium salts responsible for water hardness, thereby improving detergency.

Soaps which can function as detergency builders are those as defined hereinbefore as capable of functioning also as detergent active compounds Inorganic detergency builders include, for example, water-soluble salts of phosphates, pyrophosphates, orthophosphates, polyphosphates, phosphonates, and polyphosphonates. Specific examples of inorganic phosphate builders include sodium and potassium tripolyphosphates, phosphate and hexametaphosphates. The polyphosphates can specifically include, for example, the sodium and potassium salts of ethylene diphosphonic acid, the sodium and potassium salts of ethane 1-hydroxy-1,1-diphosphonic acid, and the sodium and potassium salts of ethane-1,1,2-triphosphonic acid. Sodium tripolyphosphate is an especially preferred, water-insoluble inorganic builder.

Non-phosphorus-containing inorganic water-soluble sequestrants can also be selected for use as detergency builders. Specific examples of such non-phosphorus, inorganic builders include borate, silicate and aluminate salts. The alkali metal, especially sodium or potassium, salts are particularly preferred.

Organic non-phosphorus-containing, water-soluble detergency builders include, for example, the alkali metal, ammonium and substituted ammonium polyacetates, carboxylates, polycarboxylates, succinates, oxalates and polyhydroxysulphonates. Specific examples of the polyacetate and polycarboxylate builder salts include sodium, potassium, lithium, ammonium and substituted ammonium salts of ethylenediamine tetraacetic acid, nitrilotriacetic acid, oxydisuccinic acid, mellitic acid, benzene polycarboxylic acids, citric acid, carboxymethoxysuccinic acid, carboxymethyoxymalonic acid and mixtures thereof.

Highly preferred organic water-soluble non-phosphorus-containing builders include sodium silicate, sodium citrate, sodium oxydisuccinate, sodium mellitate, sodium nitrilotriacetate, and sodium ethylenediaminetetraacetate.

Another type of detergency builder material useful in the compositions and products of the invention comprise a water-soluble material capable of forming a water-insoluble reaction product with water hardness cations, such as alkali metal or ammonium salts of carbonate, bicarbionate and sesquicarbonate optionally in combination with a crystallisation seed which is capable of providing growth sites for said reaction product.

Other types of builder that can be used include various substantially water-insoluble materials which are capable of reducing the hardness content of laundering liquors by an ion-exchange process.

Examples of such ion-exchange materials are the complex aluminosilicates, i.e. zeolite-type materials, which are useful presoaking or washing adjuncts which soften water by removal of calcium ion. Both the naturally occurring and synthetic "zeolites", especially Zeolite A and hydrated Zeolite A materials, are useful as builders.

The detergency builder component when present will generally comprise from about 1% to 90%, preferably from about 5% to 75% by weight of the product.

Other detergent adjuncts

Further detergent adjuncts which can optionally be employed in the compositions and products of the invention include superfatting agents, such as free long-chain fatty acids, lather boosters such as alkanolamides, particularly the monoethanolamides derived from palmkernel fatty acids and coconut fatty acids; lather controllers such as antifoam granules containing hydrocarbons, oils and waxes, and alkyl phosphates and silicones; anti-redeposition agents such as sodium carboxymethyl-cellulose, polyvinyl pyrrolidone and the cellulose ethers such as methyl cellulose and ethyl hydroxyethyl cellulose; stabilisers such as ethylenediamine tetramethylene phosphonate and diethylenetriamine pentamethylene phosphonate; fabric-softening agents; inorganic salts such as sodium and magnesium sulphate; and—usually present in very minor amounts—optical brighteners, fluorescers, enzymes such as proteases and amylases, anti-caking agents, thickeners, germicides and colourants.

Various detergency enzymes well-known in the art for their ability to degrade and aid in the removal of various soils and stains can also optionally be employed in products according to this invention. Detergency enzymes are commonly used at concentrations of from about 0.1% to about 1.0% by weight of such compositions. Typical enzyme include the various proteases, lipases, amylases, and mixtures thereof, which are designed to remove a variety of soils and stains from fabrics.

It is also desirable to include one or more antideposition agents in the bleach-containing compositions of the invention, to decrease a tendency to form inorganic deposits on washed fabrics. The amount of any such antideposition agent when employed is normally from 0.1% to 5% by weight, preferably from 0.2% to 2.5% by weight of the composition. The preferred antideposition agents are anionic polyelectrolytes, especially polymeric aliphatic carboxylates, or organic phosphonates.

It may also be desirable to include in the bleach-containing compositions an amount of an alkali metal silicate, particularly sodium ortho-, meta- or preferably neutral or alkaline silicate. The presence of such alkali metal silicates at levels of at least 1%, and preferably from 5% to 15% by weight of the product, is advantageous in decreasing the corrosion of metal parts in washing machines, besides providing some measure of building and giving processing benefits and generally improved powder properties. The more highly alkaline ortho- and meta-silicates would normally only be used at lower amounts within this range, in admixture with the neutral or alkaline silicates.

The detergent products containing bleach and the bleach-stable deodorant perfumes of the invention are usually required to be alkaline, but not too strongly alkaline as this could result in fabric damage and also be hazardous for domestic use. In practice the products should preferably provide a pH of from about 8.5 to about 11 in use in the aqueous wash liquor. It is preferred in particular for domestic products to yield a pH of from about 9.0 to about 10.5, as lower pH values tend to be less effective for optimum detergency, and more highly alkaline products can be hazardous if misused. The pH is measured at the lowest normal usage concentration of 0.1% w/v of the product in water of 12° H (Ca) (French permanent hardness, calcium only) at 50° C. so that a satisfactory degree of alkalinity can be assured in use at all normal product concentrations.

The total amount of detergent adjuncts that can be incorporated into the deodorant detergent product according to the invention will normally form the balance of the product after accounting for the bleach-stable deodorant perfume and the detergent-active compound. The detergent adjuncts will accordingly form from 0 to 94.99% by weight of the product.

Deodorant detergent product types

The deodorant detergent product can be formulated as a solid product, for example in the form of a laundry bar or a powder which can be used for fabric washing. Alternatively, the product can take the form of a liquid, gel or paste for fabric washing.

It is to be understood that the foregoing products are examples of forms which the deodorant detergent product can take: other product forms within the purview of the art are to be included within the scope of monopoly claimed.

Preparation of deodorant detergent products

The process for preparing deodorant detergent products thereby employing a bleach-stable deodorant perfume as a means for reducing or eliminating malodour from a fabric garment washed therewith comprises mixing with detergent-active compounds and detergent adjuncts, if present, from 0.01 to 5% by weight of a bleach-stable deodorant perfume to provide a deodorant detergent product, the bleach-stable deodorant perfume having a deodorant value of at least 0.25 as measured by the Malodour Reduction Value Test. The selection of detergent active compounds and detergent adjuncts, including the bleach ingredients, and their respective amounts employed in the process of the invention will depend upon the nature of the required detergent product (e.g. solid or liquid) and the purpose for which it is required (e.g. for cleaning hard surfaces or for fabric washing).

Usually it is convenient to add the bleach-stable deodorant perfume to the detergent product at a stage towards the end of its manufacture so that loss of any volatile ingredients such as may occur during a heating step is minimised.

It is furthermore usual to incorporates the bleach-stable deodorant perfume in such a manner that it is thoroughly mixed with the other ingredients and is uniformly distributed throughout the detergent product. It is however also possible, particularly with solid products such as marbled laundry bars and speckled or spotted solid or liquid products, where the bleach-stable deodorant perfume can be encapsulated to delay its subsequent release, to provide detergent products where the bleach-stable deodorant perfume is not uniformly and homogeneously mixed with the other ingredients of the detergent product, and is concentrated in the marbled bands or the speckled or spotted parts of such products.

Liquid products can be prepared simply by mixing the ingredients in any desired order, although it is preferable to add any volatile components which can include the bleach-stable deodorant perfume towards the end of the mixing process to limit loss by evaporation of these volatile components. Some agitation is usually necessary to ensure proper dispersion of any insoluble ingredients and proper dissolution of soluble ingredients.

Solid products in the form of a powder can be prepared by first making a slurry with water of all ingredients of the composition except those which are heat labile, volatile or otherwise unstable to heating, for example the bleach-stable deodorant perfume.

By way of example, a typical slurry will comprise the following substances in solution or dispersion in water, in the ratios given:

| | Parts by weight |
|---|---|
| Sodium dodecylbenzene sulphonate paste | 13.15 |
| $C_{13-15}$ fatty alcohol 7EO | 2.9 |
| Sodium tripolyphosphate | 23.9 |
| Alkaline sodium silicate (solution) | 9 |
| Sodium carboxymethyl cellulose | 7.2 |
| Sodium ethylenediamine tetraacetic acid | 1.4 |
| Magnesium sulphate heptahydrate | 7.2 |
| Sodium sulphate | 10.3 |
| Water | 39.3 |

It is to be noted that the sodium dodecylbenzene sulphonate and the alkaline silicates contain water, and that the magnesium sulphate will react in the slurry to yield magnesium silicate in the product after spray drying. The solids content of the slurry is 46%.

The aqueous slurry is then spray dried by a conventional technique to produce detergent granules containing not more than 18%, preferably from 6 to 12% by weight of moisture.

Additional detergent composition components including the bleach-stable deodorant perfume, bleach and bleach activator are then mixed with the spray dried detergent granules.

In a typical example, the finished product has the following composition:

| | % w/w |
|---|---|
| Spray dried detergent granules | 76 |
| Deodorant bleach-stable perfume | 0.2 |
| Sodium perborate tetrahydrate | 13 |
| TAED granules (65% TAED) | 10.8 |

Solid products in the form of a bar or tablet can be prepared by first mixing together the heat stable, non-volatile materials and then adding heat labile volatile materials, such as the deodorant bleach-stable perfume at a later stage in the process, preferably shortly before extruding and stamping.

Use of Deodorant Detergent Products

The deodorant detergent product can be employed in a normal domestic or other laundry process conveniently employing a washing machine. It is intended that the product is effective both in removing soil from fabrics being washed, in bleaching the fabric and in delivering to the fabric a deodorant effective amount of the bleach-stable deodorant perfume. A 'deodorant effective amount' of the deodorant product is defined as sufficient of the product to reduce body malodour (as measured by the Malodour Reduction Value Tesrt) when the fabric, in the form of a shirt to be worn in contact with the skin, has been subjected to a laundry washing process employing the deodorant detergent product.

For most purposes, the detergent product can then be employed at a concentration of 0.05 to 5% by weight of the wash liquor. Preferably, the concentration in the wash is from 0.2 to 2%, most preferably from 0.3 to 1% by weight of the wash liquor.

According to a preferred method of using the deodorant detergent product as a fabric washing product, it can for example be applied to a garment according to conventional laundering procedures involving water washing, rinsing and drying. It is apparent that sufficient of the bleach-stable deodorant perfume is delivered to and remains on the fabric of laundered garments subsequently to enable the wearer to benefit from its deodorising effect by reduction of body malodour.

The following laundering procedure is given to illustrate the application of a deodorant detergent fabric washing product to shirts.

Polyester cotton coat style button through shirts were washed in an automatic washing machine using a detergent fabric washing powder containing sodium perborate tetrahydrate and TAED and a bleach-stable deodorant perfume at a concentration of 0.2% by weight of the product as herein defined. The concentration of the product in the wash liquor was 0.4% by weight of the liquor. The ratio of shirt fabric (dry weight basis) to wash liquor was 40 g fabric per liter wash liquor.

The shirts were agitated in the wash liquor for 10 minutes at a temperature of 50° C., then rinsed and spun to a moisture content of abut 50% water and finally line dried to a moisture content of not greater than 10%.

The shirts were folded and stored until required for use.

The deodorant detergent product can also be employed in the cleaning of hard surfaces, for example those to be found in the domestic kitchen and bathroom.

The invention will now be illustrated by the following non-limiting examples.

EXAMPLE 1

A bleach-stable deodorant perfume was prepared from the following bleach-stable components and ingredients:

| Bleach-stable deodorant perfume A7 | | | |
|---|---|---|---|
| Components | Parts | Class | Total in Class |
| iso-Amyl salicylate | 6.0 | 1 | 21.0 |
| Hexyl salicylate | 15.0 | 1 | |
| Rose AB 409 | 20.0 | 2 | 20.0 |

-continued

| Bleach-stable deodorant perfume A7 | | | |
|---|---|---|---|
| 6-Acetyl-1,3,3,4,4,6-hexa-methyltetrahydro-naphthalene | 2.5 | 3 | 4.5 |
| p-t Amyl cyclohexanone | 2.0 | 3 | |
| Diethyl phthalate | 10.0 | 5 | 10.0 |
| Cinnamic alcohol | 10.0 | 6 | 20.75 |
| Dimyrcetol | 10.0 | 6 | |
| 3a-Methyl-dodecahydro-6,6,9a-trimethyl-naphtho-2(2,1-b) furan | 0.75 | 6 | |
| Ingredients | | | |
| Dimethyl benzyl carbinyl acetate | 2.5 | | |
| Dipropylene glycol | 11.25 | | |
| iso-Butyl phenyl acetate | 5.0 | | |
| Phenyl ethyl alcohol | 5.0 | | |
| | 100.0 | | |
| Total amount of components | | 76.25% w/w | |
| Number of components present | | 9 | |
| Number of classes represented | | 5 | |

The perfume was subjected to the Malodour Reduction Value test as herein described with the following results:

| Results of Malodour Reduction Value Test for bleach-stable deodorant perfume A7 | | |
|---|---|---|
| | Shirt Fabric Insert | |
| | Control | Test |
| Average scores | 2.72 | 2.13 |
| Malodour Reduction Value | | 0.59 |

The Malodour Reduction Value fell within the range of 0.25 to 3.0 as defined herein, thus confirming the perfume A7 was indeed a bleach-stable deodorant deodorant perfume according to the invention.

EXAMPLE 2

A bleach-stable deodorant perfume was prepared from the following bleach-stable components and ingredients:

| Bleach-stable deodorant perfume A8 | | | |
|---|---|---|---|
| Components | Parts | Class | Total in class |
| Ethyl salicylate | 9.0 | 1 | 10.2 |
| iso-Eugenol | 1.2 | 1 | |
| Bergamot AB 430 | 15.0 | 2 | 25.0 |
| Rose AB 380 | 10.0 | 2 | |
| o-t-Butylcyclohexylacetate | 1.0 | 5 | 5.0 |
| Diethylphthalate | 4.0 | 5 | |
| 1,3,4,6,7,8-Hexahydro-4,6,6,7,8,8-hexamethyl cyclopenta-α-2-benzopyran | 10.0 | 6 | 10.0 |
| Ingredients | | | |
| Anethole | 0.6 | | |
| Citronellol | 4.0 | | |
| Citronellyl acetate | 11.5 | | |
| Geraniol | 2.0 | | |
| Geranium oil Bourbon | 7.0 | | |
| Lavandin oil | 18.0 | | |
| Patchouli oil | 6.7 | | |
| | 100.0 | | |
| Total amount of components | | 50.2% w/w | |
| Number of components present | | 7 | |
| Number of classes represented | | 4 | |

The perfume was subjected to the Malodour Reduction Value Test as herein described with the following results:

| Results of Malodour Reduction Value Test for bleach-stable deodorant perfume A8 | | |
|---|---|---|
| | Shirt Fabric Insert | |
| | Control | Test |
| Average scores | 2.46 | 1.67 |
| Malodour Reduction Value | | 0.79 |

The Malodour Reduction Value fell within the range of 0.25 to 3.0 as defined herein, thus confirming the perfume A8 was indeed a bleach-stable deodorant perfume according to the invention.

EXAMPLE 3

A bleach-stable deodorant perfume was prepared from the following bleach-stable components and ingredients:

| Bleach-stable deodorant perfume A9 | | | |
|---|---|---|---|
| Components | Parts | Class | Total in class |
| iso-Amyl salicylate | 3.5 | 1 | 4.5 |
| Hexyl salicylate | 1.0 | 1 | |
| Bergamot AB 430 | 20.0 | 2 | 26.0 |
| Rose AB 409 | 6.0 | 2 | |
| 6-Acetyl-1,3,3,4,4,6-hexa-methyl-tetrahydronaphthalene | 3.0 | 3 | 8.0 |
| p-t-Amylcyclohexanone | 5.0 | 3 | |
| iso-Butyl quinoline | 1.5 | 4 | 1.5 |
| Cinnamic alcohol | 12.2 | 6 | 24.2 |
| 1,3,4,6,7,8-Hexahydro-4,6,6,7,8,8-hexamethylcyclopenta-α-2-benzopyran | 10.00 | 6 | |
| 3a-Methyl-dodecahydro-6,6,9a-trimethylnaphtho-2(2,1-b) furan | 2.0 | 6 | |
| Ingredients | | | |
| Benzyl acetate | 8.0 | | |
| Citronellol | 4.8 | | |
| Citronellyl acetate | 5.0 | | |
| Lauric alcohol | 4.0 | | |
| Lavendin oil | 14.0 | | |
| | 100.0 | | |
| Total amount of components | | 64.2% w/w | |
| Number of components present | | 10 | |
| Number of classes represented | | 5 | |

The perfume was subjected to the Malodour Reduction Value test as herein described with the following results

| Results of Malodour Reduction Value Test for bleach-stable deodorant perfume A9 | | |
|---|---|---|
| | Shirt Fabric Insert | |
| | Control | Test |
| Average scores | 2.83 | 2.47 |
| Malodour Reduction Value | | 0.36 |

The Malodour Reduction Value fell within the range of 0.25 to 3.0 as defined herein, thus confirming the perfume A9 was indeed a bleach-stable deodorant perfume according to the invention.

EXAMPLE 4

A bleach-stable deodorant perfume was prepared from the following bleach-stable components and ingredients:

| Bleach-stable deodorant perfume A10 | | | |
|---|---|---|---|
| Components | Parts | Class | Total in class |
| iso-Eugenol | 1.5 | 1 | 16.5 |
| Hexyl salicylate | 15.0 | 1 | |
| Bergamot AB 430 | 15.0 | 2 | 15.0 |
| p-t-Amyl cyclohexanone | 3.0 | 3 | 15.0 |
| α-iso-Methyl ionone | 12.0 | 3 | |
| Diethylphthalate | 4.5 | 5 | 4.5 |
| 1,3,4,6,7,8-Hexahydro-4,6,6,7,8,8-hexamethyl-cyclopenta-α-2-benzopyran | 4.0 | 6 | 4.0 |
| Ingredients | | | |
| Benzyl acetate | 7.0 | | |
| Citronellol | 3.0 | | |
| Geranium oil Bourbon | 9.0 | | |
| Geranyl acetate | 6.0 | | |
| Lavandin oil | 10.0 | | |
| Patchouli oil | 10.0 | | |
| | 100.0 | | |
| Total amount of components | | 55% w/w | |
| Number of components present | | 7 | |
| Number of classes represented | | 5 | |

The perfume was subjected to the Malodour Reduction Value test as herein described with the following results:

| Results of Malodour Reduction Value Test for bleach-stable deodorant perfume A10 | | |
|---|---|---|
| | Shirt Fabric Insert | |
| | Control | Test |
| Average scores | 2.66 | 1.79 |
| Malodour Reduction Value | | 0.87 |

The Malodour Reduction Value fell within the range of 0.25 to 3.0 as defined herein, thus confirming the perfume A10 was indeed a bleach-stable deodorant perfume according to the invention.

EXAMPLE 5

A bleach-stable deodorant perfume was prepared from the following bleach-stable components and ingredients:

| Bleach-stable deodorant perfume A11 | | | |
|---|---|---|---|
| Components | Parts | Class | Total in class |
| iso-Eugenol | 5.0 | 1 | 6.5 |
| Hexyl salicylate | 1.5 | 1 | |
| Rose AB 409 | 8.0 | 2 | 8.0 |
| 2-n-Heptyl cyclopentanone | 0.5 | 3 | 10.5 |
| α-iso-Methyl ionone | 10.0 | 3 | |
| Diethyl phthalate | 3.0 | 5 | 17.0 |
| Nonanediol-1,3-diacetate | 4.0 | 5 | |
| i-Nonyl formate | 5.0 | 5 | |
| Phenylethyl phenylacetate | 5.0 | 5 | |
| 1,3,4,6,7,8-Hexahydro-4,6,6,7,8,8-hexamethylcyclo-penta-α-2-benzopyran | 7.5 | 6 | 14.2 |
| 3a-Methyl-dodecahydro-6,6,9a-trimethyl-naphtho-2(2,1-b) furan | 0.7 | 6 | |
| Tetrahydromuguol | 6.0 | 6 | |
| Ingredients | | | |
| Benzyl acetate | 4.8 | | |
| Citronellol | 10.0 | | |
| Dihydroterpineol | 6.0 | | |
| Geranium oil Bourbon | 7.0 | | |
| Lavandin oil | 8.0 | | |
| Patchouli oil | 8.0 | | |
| | 100.0 | | |
| Total amount of components | | 56.2% w/w | |
| Number of components present | | 12 | |
| Number of classes represented | | 5 | |

The perfume was subjected to the Malodour Reduction Value test as herein described with the following results:

| Results of Malodour Reduction Value Test for bleach-stable deodorant perfume A11 | | |
|---|---|---|
| | Shirt Fabric Insert | |
| | Control | Test |
| Average scores | 2.74 | 2.45 |
| Malodour Reduction Value | | 0.29 |

The Malodour Reduction Value fell within the range of 0.25 to 3.0 as defined herein, thus confirming the perfume A11 was indeed a bleach-stable deodorant perfume according to the invention.

EXAMPLE 6

A bleach-stable deodorant perfume was prepared from the following bleach-stable components and ingredients:

| Bleach-stable deodorant perfume A12 | | | |
|---|---|---|---|
| Components | Parts | Class | Total in class |
| iso-Amyl salicylate | 5.0 | 1 | 20.0 |
| Ethyl salicylate | 5.0 | 1 | |
| Hexyl salicylate | 10.0 | 1 | |
| Bergamot AB 430 | 15.0 | 2 | 15.0 |
| 6-Acetyl-1,3,3,4,4,6-hexamethyl-tetrahydro-naphthalene | 2.5 | 3 | 4.5 |
| p-t-Amyl cyclohexanone | 2.0 | 3 | |
| iso-Butyl quinolene | 4.0 | 4 | 4.0 |
| Diethyl phthalate | 8.0 | 5 | 8.0 |
| Dimyrcetol | 10.0 | 6 | 10.8 |
| 3a-Methyl-dodecahydro-6,6,9a-trimethyl-naphtho-2(2,1-b) furan | 0.8 | 6 | |
| Ingredients | | | |
| Benzyl benzoate | 14.7 | | |
| iso-Butyl phenylacetate | 5.0 | | |
| Dimethyl benzylcarbinol acetate | 2.5 | | |
| Geraniol | 5.0 | | |
| Linalyl acetate | 4.5 | | |
| Patchouli oil | 6.0 | | |
| | 100.0 | | |
| Total number of components | | 62.3% w/w | |
| Number of components present | | 10 | |
| Number of classes represented | | 6 | |

The perfume was subjected to the Malodour Reduction Value test as herein described with the following results:

| Results of Malodour Reduction Value Test for bleach-stable deodorant perfume A12 | Shirt Fabric Insert | |
|---|---|---|
| | Control | Test |
| Average scores | 2.78 | 2.47 |
| Malodour Reduction Value | | 0.31 |

The Malodour Reduction Value fell within the range of 0.25 to 3.0 as defined herein, thus confirming the perfume A12 was indeed a bleach-stable deodorant perfume according to the invention.

EXAMPLE 7

A bleach-stable deodorant perfume was prepared from the following bleach-stable components and ingredients.

| Bleach-stable deodorant perfume A13 | | | |
|---|---|---|---|
| Components | Parts | Class | Total in class |
| Carvacrol | 5.0 | 1 | 6.5 |
| iso-Eugenol | 1.5 | 1 | |
| β-Methyl naphthyl ketone | 15.0 | 3 | 15.0 |
| o-t-Butylcyclohexyl acetate | 2.0 | 5 | 21.5 |
| Diethyl phthalate | 9.5 | 5 | |
| i-Nonyl acetate | 10.0 | 5 | |
| Hydroxymethyl iso-propyl-cyclopentane | 10.0 | 6 | 10.5 |
| 3a-Methyl-dodecahydro-6,6,9a-trimethyl-naphtho-2(2,1-b) furan | 0.5 | 6 | |
| Ingredients | | | |
| Benzyl propionate | 4.0 | | |
| iso-Butyl-benzoate | 5.0 | | |
| Citronellol | 7.5 | | |
| Dimethylbenzylcarbinol acetate | 5.0 | | |
| Lavandin oil | 15.0 | | |
| Patchouli oil | 10.0 | | |
| | 100.0 | | |
| Total amount of components | | 53.5% w/w | |
| Number of components present | | 8 | |
| Number of classes represented | | 4 | |

The perfume was subjected to the Malodour Reduction Value test as herein described with the following results:

| Results of Malodour Reduction Value Test for bleach-stable deodorant perfume A13 | Shirt Fabric Insert | |
|---|---|---|
| | Control | Test |
| Average scores | 2.60 | 2.27 |
| Malodour Reduction Value | | 0.33 |

The Malodour Reduction Value fell within the range of 0.25 to 3.0 as defined herein, thus confirming the perfume A13 was indeed a deodorant bleach-stable deodorant perfume according to the invention.

EXAMPLE 8

An example of a bleach composition according to the invention which does not contain a detergent-active compound is as follows:

| | % w/w |
|---|---|
| Sodium perborate tetrahydrate | 25 |

-continued

| | % w/w |
|---|---|
| TAED granules | 25 |
| Sodium carbonate | 47 |
| Bleach-stable deodorant perfume A7 | 0.5 |
| Minor ingredients | to 100 |

This bleaching composition is suitable for addition to wash liquor in a laundry process for bleaching fabrics. The composition can be used either with or without a conventional fabric washing detergent powder.

EXAMPLE 9

This example illustrates the use of bleach-stable deodorant perfume A7 of Example 1 in a detergent washing powder containing bleach substances.

A spray dried granular non-soap detergent containing bleach substances was prepared according to conventional spray drying techniques, the bleach substances comprising the peroxy bleach compound and bleach activator and also the deodorant perfume being mixed with the detergent after spray drying. The detergent-containing bleaching composition had the following formulation:

| | % w/w |
|---|---|
| Sodium dodecylbenzene sulphonate | 14 |
| Sodium triphosphate | 40 |
| Sodium sulphate | 2 |
| Sodium carboxymethyl cellulose | 1 |
| Ethylenediamine tetracetic acid (EDTA) | 1 |
| Magnesium silicate | 2 |
| Fluorescer | 0.3 |
| Water glass powder ($Na_2O:SiO_2$ = 1:3.4) | 5.9 |
| Sodium carbonate | 1 |
| Sodium perborate tetrahydrate | 16 |
| Tetraacetyl ethylenediamine (TAED) | 8 |
| Deodorant perfume A7 | 0.2 |
| Water | to 100 |

This detergent powder can be employed in the washing of soiled fabric garments such as shirts and underclothes as well as bed linen to yield clean fabric having a fresh fragrance and absence of malodour associated with the soiled fabric. Fabric garments and linen so washed will retain their freshness with absence of malodour even after subsequent wear or use in contact with human skin.

It can be concluded that in spite of the presence in the detergent powder of both TAED and sodium perborate tetrahydrate, which bleach ingredients tend to render ordinary perfumes unstable, the ability of the bleach-stable deodorant perfume to reduce human body malodour is nonetheless unimpaired.

EXAMPLE 10

A fabric washing deodorant detergent powder product according to the invention had the following formulation:

| | % w/w |
|---|---|
| Linear alkylbenzene sulphonate | 4 |
| Primary alcohol sulphate | 2 |
| $C_{13-15}$ alcohol 7EO | 2 |
| $C_{20-22}$ soap | 3 |
| Zeolite | 30 |
| Sodium nitrilotriacetate | 10 |
| Alkaline sodium silicate | 6 |
| Sodium ethylenediamine tetraacetate | 0.2 |

-continued

| | % w/w |
|---|---|
| Sodium carboxymethyl cellulose | 0.5 |
| Perfume A8 | 0.3 |
| Sodium perborate tetrahydrate | 15 |
| TAED granules (65% active) | 2 |
| Water, sodium sulphate & other minor ingredients | to 100 |

EXAMPLE 11

A fabric washing deodorant detergent powder product according to the invention had the following formulation:

| | % w/w |
|---|---|
| Linear alkylbenzene sulphonate | 6.5 |
| $C_{13-15}$ alcohol 7EO | 3 |
| $C_{20-22}$ soap | 5 |
| Sodium tripolyphosphate | 15 |
| Sodium orthophosphate | 5 |
| Alkaline sodium silicate | 10 |
| Sodium ethylenediamine tetraacetate | 0.15 |
| Ethylenediamine N,N,N'N'—[tetra(methylene phosphonic acid)] | 0.2 |
| Sodium carboxymethyl cellulose | 0.6 |
| Perfume A9 | 0.4 |
| Sodium perborate tetrahydrate | 15 |
| TAED granules (65% active) | 2.5 |
| Water, sodium sulphate & other minor ingredients | to 100 |

EXAMPLE 12

A fabric washing deodorant detergent powder product according to the invention had the following formulation:

| | % w/w |
|---|---|
| Linear alkylbenzene sulphonate | 9 |
| $C_{13-15}$ alcohol 7EO | 4 |
| Sodium tripolyphosphate | 16 |
| Zeolite | 8 |
| Alkaline sodium silicate | 4 |
| Magnesium silicate | 0.4 |
| Ethylenediamine N,N,N'N'—[tetra(methylene phosphonic acid)] | 0.3 |
| Sodium carboxymethyl cellulose | 0.6 |
| Anti-foam | 1.5 |
| Perfume A10 | 0.5 |
| Sodium perborate tetrahydrate | 11 |
| TAED granules (65% active) | 2.5 |
| Water, sodium sulphate & other minor ingredients | to 100 |

EXAMPLE 13

A fabric washing deodorant detergent powder product according to the invention had the following formulation:

| | % w/w |
|---|---|
| Linear alkylbenzene sulphonate | 4 |
| $C_{13-15}$ alcohol 7EO | 9 |
| Sodium tripolyphosphate | 23 |
| Neutral sodium silicate | 6 |
| Sodium ethylenediamine tetraacetate | 0.2 |
| Magnesium ethylenediamine N,N,N'N'—[tetra(methylene phosphonate)] | 0.5 |
| Sodium carboxymethyl cellulose | 0.7 |
| Polymer | 2 |

-continued

| | % w/w |
|---|---|
| Anti-foam | 0.5 |
| Perfume A11 | 1.0 |
| Sodium perborate tetrahydrate | 10 |
| TAED granules (65% active) | 4.5 |
| Water, sodium sulphate & other minor ingredients | to 100 |

EXAMPLE 14

A fabric washing deodorant detergent powder product according to the invention had the following formulation:

| | % w/w |
|---|---|
| Linear alkylbenzene sulphonate | 6 |
| $C_{13-15}$ alcohol 7EO | 4 |
| Sodium tripolyphosphate | 18 |
| Zeolite | 13 |
| Alkaline sodium silicate | 2 |
| Sodium carbonate | 5 |
| Sodium ethylenediamine tetraacetate | 0.15 |
| Calcium ethylenediamine N,N,N',N'—[tetra(methylene phosphonate)] | 0.3 |
| Sodium carboxymethyl cellulose | 0.5 |
| Polymer | 0.75 |
| Antifoam | 1 |
| Perfume A12 | 0.5 |
| Sodium perborate monohydrate | 6 |
| TAED granules (65% active) | 5.5 |
| Water, sodium sulphate & other minor ingredients | to 100 |

EXAMPLE 15

A fabric washing deodorant detergent powder product according to the invention had the following formulation:

| | % w/w |
|---|---|
| Linear alkylbenzene sulphonate | 8 |
| $C_{13-15}$ alcohol 7EO | 3.5 |
| $C_{20-22}$ soap | 5.5 |
| Sodium tripolyphosphate | 27 |
| Alkaline sodium silicate | 8 |
| Sodium ethylenediamine tetraacetate | 0.2 |
| Calcium ethylenediamine N,N,N'N'—[tetra(methylene phosphonate)] | 0.2 |
| Sodium carboxymethyl cellulose | 0.4 |
| Perfume A13 | 0.2 |
| Sodium perborate tetrahydrate | 9 |
| TAED granules (65% active) | 3.5 |
| Water, sodium sulphate & other minor ingredients | to 100 |

EXAMPLE 16

A fabric washing deodorant detergent powder product according to the invention had the following formulation:

| | % w/w |
|---|---|
| Primary alcohol sulphate | 6 |
| $C_{13-15}$ alcohol 7EO | 2 |
| $C_{20-22}$ soap | 3 |
| Sodium tripolyphosphate | 20 |
| Sodium nitrilotriacetate | 5 |
| Alkaline sodium silicate | 7 |
| Sodium ethylenediamine tetraacetate | 0.2 |
| Magnesium ethylenediamine | 0.4 |

-continued

| | % w/w |
|---|---|
| N,N,N'N'—[tetra(methylene phosphonate)] | |
| Sodium carboxymethyl cellulose | 0.6 |
| Perfume A8 | 4 |
| Sodium perborate tetrahydrate | 15 |
| TAED granules (65% active) | 3 |
| Water, sodium sulphate & other minor ingredients | to 100 |

EXAMPLE 17

A fabric washing deodorant detergent powder product according to the invention had the following formulation:

| | % w/w |
|---|---|
| Linear alkylbenzene sulphonate | 9 |
| $C_{13-15}$ alcohol 7EO | 4 |
| Zeolite | 40 |
| Alkaline sodium silicate | 8 |
| Sodium ethylenediamine tetraacetate | 0.2 |
| Calcium ethylenediamine | 0.3 |
| N,N,N'N'—[tetra(methylene phosphonate)] | |
| Sodium carboxymethyl cellulose | 0.6 |
| Anti-foam | 1.5 |
| Perfume A10 | 0.1 |
| Sodium perborate tetrahydrate | 15 |
| TAED granules (65% active) | 2.5 |
| Water, sodium sulphate & other minor ingredients | to 100 |

EXAMPLE 18

A fabric washing deodorant detergent powder product according to the invention had the following formulation:

| | % w/w |
|---|---|
| Linear alkylbenzene sulphonate | 9 |
| $C_{13-15}$ alcohol 7EO | 4 |
| Zeolite | 40 |
| Alkaline sodium silicate | 8 |
| Sodium ethylenediamine tetraacetate | 0.2 |
| Calcium ethylenediamine | 0.3 |
| N,N,N'N'—[tetra(methylene phosphonate)] | |
| Sodium carboxymethyl cellulose | 0.6 |
| Anti-foam | 1.5 |
| Perfume A10 | 0.1 |
| Sodium percarbonate | 2.5 |
| N,N,N'N'—tetraacetyl glycoluril | |
| Water, sodium sulphate & other minor ingredients | to 100 |

EXAMPLE 19

A fabric washing deodorant detergent powder product according to the invention had the following formulation:

| | % w/w |
|---|---|
| Primary alcohol sulphate | 6 |
| $C_{13-15}$ alcohol 7EO | 2 |
| $C_{20-22}$ soap | 3 |
| Sodium tripolyphosphate | 20 |
| Sodium nitriolotriacetate | 5 |
| Alkaline sodium silicate | 7 |
| Sodium ethylenediamine tetraacetate | 0.2 |
| Magnesium ethylenediamine | 0.4 |
| N,N,N'N'—[tetra(methylene phosphonate)] | |
| Sodium carboxymethyl cellulose | 0.6 |

-continued

| | % w/w |
|---|---|
| Perfume A8 | 0.4 |
| Sodium persilicate | 15 |
| Glucose pentaacetate | 3 |
| Water, sodium sulphate & other minor ingredients | to 100 |

EXAMPLE 20

A fabric washing deodorant detergent powder product according to the invention had the following formulation:

| | % w/w |
|---|---|
| Linear alkylbenzene sulphonate | 8 |
| $C_{13-15}$ alcohol 7EO | 3.5 |
| $C_{20-22}$ soap | 5.5 |
| Sodium tripolyphosphate | 27 |
| Alkaline sodium silicate | 8 |
| Sodium ethylenediamine tetraacetate | 0.2 |
| Calcium ethylenediamine | 0.2 |
| N,N,N'N'—[tetra-(methylene phosphonate)] | |
| Sodium carboxymethyl cellulose | 0.4 |
| Perfume A13 | 2 |
| Sodium perphosphate | 9 |
| Sodium acetoxybenzene sulphonate | 7 |
| Water, sodium sulphate & other minor ingredients | to 100 |

EXAMPLE 21

A fabric washing deodorant detergent powder product according to the invention had the following formulation:

| | % w/w |
|---|---|
| Linear alkylbenzene sulphonate | 6 |
| $C_{13-15}$ alcohol 7EO | 4 |
| Sodium tripolyphosphate | 18 |
| Zeolite | 13 |
| Alkaline sodium silicate | 2 |
| Sodium carbonate | 5 |
| Sodium ethylenediamine tetraacetate | 0.15 |
| Calcium ethylene diamine | 0.3 |
| N,N,N'N'—[tetra(methylene phosphonate)] | |
| Sodium carboxymethyl cellulose | 0.5 |
| Polymer | 0.75 |
| Anti-foam | 1 |
| Perfume A12 | 0.5 |
| Sodium perborate monohydrate | 15 |
| Sodium nonanoylphenol sulphonate | 6 |
| Water, sodium sulphate & other minor ingredients | to 100 |

EXAMPLE 22

A fabric washing deodorant detergent powder product according to the invention had the following formulation:

| | % w/w |
|---|---|
| Linear alkylbenzene sulphonate | 4 |
| $C_{13-15}$ alcohol 7EO | 9 |
| Sodium tripolyphosphate | 23 |
| Neutral sodium silicate | 6 |
| Sodium ethylenediamine tetraacetate | 0.2 |
| Magnesium ethylenediamine | 0.5 |
| N,N,N'N'—[tetra(methylene phosphonate)] | |
| Sodium carboxymethyl cellulose | 0.7 |
| Polymer | 2 |

-continued

| | % w/w |
|---|---|
| Anti-foam | 0.5 |
| Perfume A11 | 1.0 |
| Sodium perborate tetrahydrate | 13 |
| Sodium octanoylphenol sulphonate | 4 |
| Water, sodium sulphate & other minor ingredients | to 100 |

EXAMPLE 23

A fabric washing deodorant detergent powder product according to the invention had the following formulation:

| | % w/w |
|---|---|
| Linear alkylbenzene sulphonate | 9 |
| $C_{13-15}$ alcohol 7EO | 4 |
| Sodium tripolyphosphate | 16 |
| Zeolite | 8 |
| Alkaline sodium silicate | 4 |
| Magnesium silicate | 0.4 |
| Ethylenediamine N,N,N'N'—[tetra(methylene phosphonic acid)] | 0.3 |
| Sodium carboxymethyl cellulose | 0.6 |
| Anti-foam | 1.5 |
| Perfume A10 | 0.5 |
| Sodium perborate tetrahydrate | 11 |
| N,N,N'N'—tetraacetyl glycoluril | 2.5 |
| Water, sodium sulphate & other minor ingredients | to 100 |

EXAMPLE 24

A fabric washing deodorant detergent powder product according to the invention had the following formulation:

| | % w/w |
|---|---|
| Linear alkylbenzene sulphonate | 6.5 |
| $C_{13-15}$ alcohol 7EO | 3 |
| $C_{20-22}$ soap | 5 |
| Sodium tripolyphosphate | 15 |
| Sodium orthophosphate | 5 |
| Alkaline sodium silicate | 10 |
| Sodium ethylenediamine tetraacetate | 0.15 |
| Ethylenediamine N,N,N'N'—[tetra(methylene phosphonic acid)] | 0.2 |
| Sodium carboxymethyl cellulose | 0.6 |
| Perfume A9 | 0.4 |
| Sodium perborate tetrahydrate | 15 |
| Glucose pentaacetate | 2.5 |
| Water, sodium sulphate & other minor ingredients | to 100 |

EXAMPLE 25

A fabric washing deodorant detergent powder product according to the invention had the following formulation:

| | % w/w |
|---|---|
| Linear alkylbenzene sulphonate | 4 |
| Primary alcohol sulphate | 2 |
| $C_{13-15}$ alcohol 7EO | 2 |
| $C_{20-22}$ soap | 3 |
| Zeolite | 30 |
| Sodium nitriolotriacetate | 10 |
| Alkaline sodium silicate | 6 |
| Sodium ethylenediamine tetraacetate | 0.2 |
| Sodium carboxymethyl cellulose | 0.5 |

-continued

| | % w/w |
|---|---|
| Perfume A8 | 0.3 |
| Sodium perborate tetrahydrate | 15 |
| Sodium acetoxybenzene sulphonate | 3 |
| Water, sodium sulphate & other minor ingredients | to 100 |

EXAMPLE 26

A fabric washing deodorant detergent powder product according to the invention had the following formulation:

| | % w/w |
|---|---|
| Linear alkylbenzene sulphonate | 6 |
| $C_{13-15}$ alcohol 7EO | 4 |
| Alkaline silicate | 10 |
| Sodium carbonate | 30 |
| Sodium carboxymethyl cellulose | 0.6 |
| Sodium ethylenediamine tetraacetate | 0.2 |
| Anti-foam | 1.0 |
| Perfume A7 | 0.2 |
| Sodium perborate tetrahydrate | 13 |
| TAED granules (65% active) | 7 |
| Water, sodium sulphate, other minor ingredients | to 100 |

We claim:

1. A detergent powder product suitable for use in the washing of fabrics which comprises:

(i) from 5 to 40% by weight of non-soap detergent active compound comprising an anionic detergent active compound;

(ii) from 1 to 90% by weight of a non-soap detergency builder;

(iii) from 1 to 30% by weight of peroxy bleach compound together with an activator therefor;

(iv) from 0.1 to 5% by weight of a bleach-stable perfume which comprises from 50 to 100% by weight of bleach-stable deodorant perfume components having a Lipoxidase-Inhibiting Capacity of at least 50% or a Raoult Variance Ratio of at least 1.1, said components being allocated to one of six classes consisting of:

Class 1: Phenolic substances;

Class 2: Essential oils, extracts, resins and synthetic oils (denoted "AB");

Class 3: Aldehydes and ketones;

Class 4: Nitrogen-containing compounds;

Class 5: Esters;

Class 6: Alcohols and ethers;

provided that where a bleach-stable deodorant perfume component could be assigned to more than one class, said component is allocated to the class having the lower or lowest number; said components being so selected that:

(a) the bleach-stable deodorant perfume contains at least five different components;

(b) the bleach-stable deodorant perfume contains components from at least four of the six classes; and (c) any component present in the bleach-stable deodorant perfume at a concentration of less than 0.5% by weight of the said perfume is eliminated from the requirements of (a) and (b);

wherein the deodorant perfume components are judged to be stable in the presence of sodium perborate tetrahydrate and N,N,N'N'-tetraacetyl ethylenediamine (TAED) according to the Bleach Stability Test, the bleach-stable deodorant perfume having a Malodour Reduction Value of from 0.25 to 3.0 as measured by the Malodour Reduction Value Test.

2. The detergent powder product of claim 1, wherein the bleach-stable deodorant perfume has a Malodour Reduction Value of from 0.30 to 3.0.

3. The detergent powder product of claim 1, wherein the bleach-stable deodorant perfume has a Malodour Reduction Value of from 0.50 to 3.0.

4. The detergent powder product of claim 1, wherein the bleach-stable deodorant perfume has a Malodour Reduction Value of from 1.00 to 3.0.

5. The detergent powder product of claim 1, wherein the bleach-stable deodorant components are chosen from:

Class 1—Phenolic substances
- iso-amyl salicylate
- Carvacrol
- Clove leaf oil
- Ethyl salicylate
- iso-Eugenol
- Hexyl salicylate
- Thyme oil red Class 2—Essential oils, extracts, resins and synthetic oils (denoted "AB")
- Bergamot AB 430
- Geranium AB 76
- Rose AB 380
- Rose AB 409

Class 3—Aldehydes and ketones
- 6-Acetyl-1,1,3,4,4,6-hexamethyltetrahydronaphthalene
- p-t-Amyl cyclohexanone
- 2-n-Heptylcyclopentanone
- α-iso-Methyl ionone
- β-Methyl naphthyl ketone Class 4—Nitrogen-containing compounds
- iso-Butyl quinoline
- Methyl anthranilate Class 5—Esters
- o-t-Butylcyclohexyl acetate
- Diethyl phthalate
- Nonanediol-1,3-diacetate
- Nonanolide-1,4
- i-Nonyl acetate
- i-Nonyl formate
- Phenylethyl phenyl acetate Class 6—Alcohols & Ethers
- Cinnamic alcohol
- Dimycretol
- 1,3,4,6,7,8-Hexahydro-4,6,6,7,8-hexamethylcyclopenta-γ-2-benzopyran
- Hydroxymethyl isopropyl cyclopentane
- 3a-Methyl-dodecahydro-6,6,9a-trimethylnaphtho-2(2,1-b)furan
- Tetrahydromuguol.

6. A bleaching composition comprising a peroxy bleach compound and an activator therefor, and the bleach-stable deodorant perfume of claim 1.

7. The detergent powder product of claim 1, wherein the peroxy bleach compound is chosen from sodium perborate monohydrate, sodium perborate tetrahydrate and mixtures thereof.

8. The detergent powder product of claim 1, wherein the peroxy bleach activator is chosen from:
- N,N,N',N'-tetraacetyl ethylenediamine;
- N,N,N',N'-tetraacetyl glycoluril;
- Glucose pentaacetate;
- Sodium acetoxybenzene sulphonate;
- Sodium nonanoyloxybenzene sulphonate;
- Sodium octanoyloxybenzene sulphonate; and mixtures thereof.

9. The detergent powder product of claim 1, wherein the non-soap detergent active compound further comprises a nonionic detergent active compound.

10. A method of suppressing human body malodour which comprises contacting the skin with fabric washed with the detergent powder product of claim 1.

11. The detergent powder product of claim 1, wherein the non-soap anionic detergent active compound is selected from the group consisting of water-soluble alkali metal salts of organic sulphates and sulphonates having alkyl radicals containing from about 8 to about 22 carbon atoms.

12. The detergent powder product of claim 11, wherein the non-soap anionic detergent active compound is selected from the group consisting of sodium and potassium alkyl sulphates, sodium, potassium and ammonium alkyl benzene sulphonates, sodium alkyl glyceryl ether sulphates, sodium coconut oil fatty acid monoglyceride sulphates and sulphonates, sodium and potassium salts of sulphuric acid esters of higher ($C_9$–$C_{18}$) fatty alcohol-alkylene oxide, the reaction products of fatty acids esterified with isethionic acid and neutralised with sodium hydroxide, sodium and potassium salts of fatty acid amides of methyl taurine, alkane monosulphonates, olefin sulphonates and mixtures thereof.

13. The detergent powder product of claim 12, wherein the non-soap anionic detergent active compound is selected from the group consisting of sodium ($C_{11}$–$C_{15}$) alkyl benzene sulphonates, sodium ($C_{16}$–$C_{18}$) alkyl sulphates and mixtures thereof.

14. The detergent powder product of claim 9, wherein the nonionic detergent active compound is selected from the group consisting of the reaction products of alkylene oxides with alkyl ($C_6$–$C_{22}$) phenols, the condensation products of aliphatic ($C_8$–$C_{18}$) primary or secondary linear or branched alcohols with ethylene oxide, products made by condensation of ethylene oxide with the reaction products of propylene oxide and ethylene diamine, long-chain tertiary amine oxides, long-chain tertiary phosphine oxides and dialkyl sulphoxides and mixtures thereof.

15. The detergent powder product of claim 14, wherein the nonionic detergent active compound is selected from the group consisting of the reaction products of ethylene oxide with alkyl ($C_6$–$C_{22}$) phenols to provide from 5 to 25 units of ethylene oxide per molecule.

16. A detergent powder product of claim 14, wherein the nonionic detergent active compound is selected from the condensation products of aliphatic ($C_8$–$C_{18}$) primary or secondary linear or branched alcohols with ethylene oxide to provide from 4 to 30 units of ethylene oxide per molecule.

17. The detergent powder product of claim 14, in which the nonionic detergent active compound is a $C_{13}$–$C_{15}$ fatty alcohol having 7 units of ethylene oxide in the molecule.

18. The detergent powder product of claim 1, wherein the non-soap detergent active compound comprises from 8 to 30% by weight of the product.

19. The detergent powder product of claim 1, wherein the non-soap detergency builder is selected from the group consisting of water-soluble salts of phosphates, pyrophosphates, orthophosphates, polyphosphates, phosphonates, and polyphosphonates.

20. The detergent powder product of claim 19, wherein the non-soap detergency builder is sodium tripolyphosphate.

21. The detergent powder product of claim 1, wherein the non-soap detergency builder is a non-phosphorous-containing inorganic water-soluble sequestrant selected from the group consisting of sodium and potassium borates, silicates, and aluminates.

22. The detergent powder product of claim 1, wherein the non-soap detergency builder is an organic non-phosphorous-containing, water-soluble detergency builder selected from the group consisting of alkali metal, ammonium and substituted ammonium polyacetates, carboxylates, polycarboxylates, succinates, oxylates, polyhydroxysulphonates and mixtures thereof.

23. The detergent powder product of claim 1, wherein the non-soap detergency builder is selected from the group consisting of alkali metal or ammonium salts of carbonate, bicarbonate and sesquicarbonate and mixtures thereof.

24. The detergent powder product of claim 1, wherein the non-soap detergency builder is selected from the group consisting of naturally occurring and synthetic zeolites and mixtures thereof.

25. The detergent powder product of claim 1, wherein the non-soap detergency builder forms from 5 to 75% by weight of the product.

26. The detergent powder product of claim 1, wherein the peroxy bleach compound is selected from the group consisting of alkali metal perborate tetrahydrates, alkali metal perborate monohydrates, alkali metal percarbonates, persilicates and perphosphates and mixtures thereof.

27. The detergent powder product of claim 1, wherein the activator for the peroxy bleach compound is selected from the group consisting of N-diacetylated and N,N'-polyacetylated amines and mixtures thereof.

28. The detergent powder product of claim 27, wherein the activator for the peroxy bleach compounds is N,N,N',N'-tetraacetylethylenediamine (TAED).

29. The detergent powder product of claim 1, wherein the peroxy bleach compound together with the activator therefor form from 6 to 95% by weight of the product.

30. The detergent powder product of claim 1, wherein the ratio by weight of the peroxy bleach compound to the activator therefor is from about 30:1 to about 1:1.

* * * * *